United States Patent [19]

Weber

[11] Patent Number: 4,457,191

[45] Date of Patent: Jul. 3, 1984

[54] LEVER TUMBLER LOCK PICK SET

[76] Inventor: William R. Weber, 4200-50th Ave., NE., Seattle, Wash. 98105

[21] Appl. No.: 268,360

[22] Filed: May 29, 1981

[51] Int. Cl.[3] ..... E05B 19/20; B25B 27/00

[52] U.S. Cl. ..... 81/3 R

[58] Field of Search ..... 81/3 R; 70/394

[56] References Cited

U.S. PATENT DOCUMENTS

| | | | |
|---|---|---|---|
| 1,403,753 | 1/1922 | Epstein | 81/3 R |
| 1,944,006 | 1/1934 | Hanflig | 81/3 R |
| 1,977,362 | 10/1934 | Wakstein | 81/3 R |
| 2,988,939 | 6/1961 | Schiller | 81/3 R |
| 3,788,168 | 1/1974 | Steinmann | 81/3 R |
| 4,156,375 | 5/1979 | Crasnianski | 81/3 R |

*Primary Examiner*—Roscoe V. Parker

[57] ABSTRACT

A specialized lock picking set for opening lever tumbler locks. The set consists of a special pick and tension wrench. The pick lifts all the levers simultaneously to allow the bolt stop to move into the lever tumbler gates as the tension wrench exerts pressure on the bolt in the unlock direction.

1 Claim, 6 Drawing Figures

LEVER TUMBLER LOCK PICK SET

Lever tumbler locks are used for letter boxes, desk drawers, lockers etc. When keys are lost the lock is not worth making a key by impressioning. The lock is picked open and replaced with a new lock. Picking these locks can be time consuming.

It is therefore an object of the present invention to provide a special pick set which can be used to easily pick open certain types of lever tumbler locks.

The above advantages of the present invention will become apparent upon making reference to the specification to follow the claims and drawings wherein:

Figure 5:
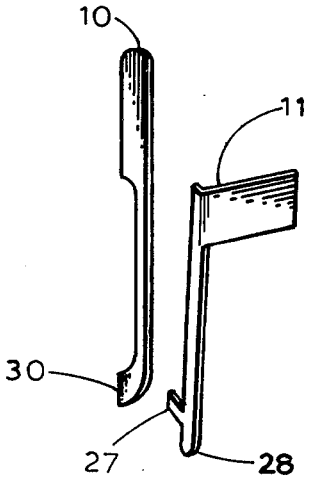
FIG. 5 shows the lock pick and tension wrench which are the subject of the present invention.
Figure 2:
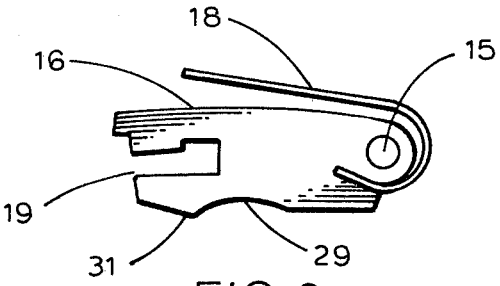
FIG. 2 is a typical lever tumbler.
Figure 1:
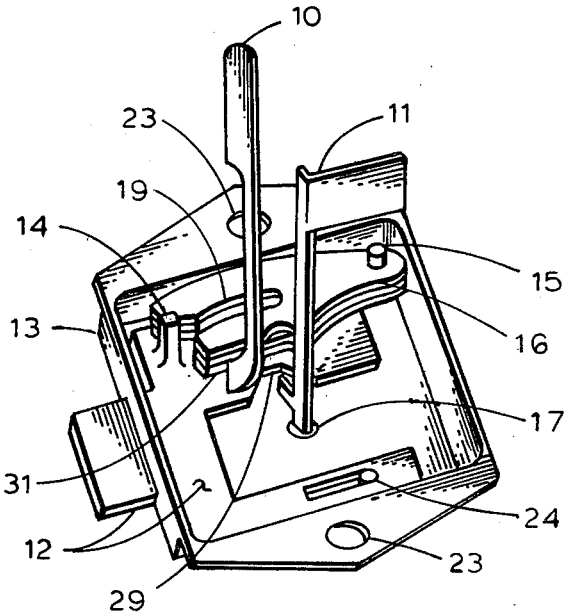
FIG. 1 is a perspective view of a lever tumbler type lock with the cover plate and key guide removed and with the pick and tension wrench in position for picking.

Refer to FIG. 1. A typical lever tumbler lock is shown with spring loaded (see 18, FIG. 2) lever tumblers 16 which rotate about pin 15. The tumblers each have a gate 19 cut in them to receive the stop 14 on the sliding bolt 12. On each tumbler a notch 29 is cut. These cuts vary in depth and are such that the proper key will lift the tumblers up the exact amount to allow the stop 14 to enter the gates 19 as the key simultaneously forces the bolt 12 back into the case 13. On some lever locks (which are those pertinent to this specification) a common surface 31 is found on each tumbler. The pick 10, surface 30, (see FIG. 5), bears against the common surfaces 31 and lifts the tumblers until the gates 19 align with the stop 14 on the bolt 12 as the tension wrench 11 forces the bolt back into the lock case 13.

Figure 3:
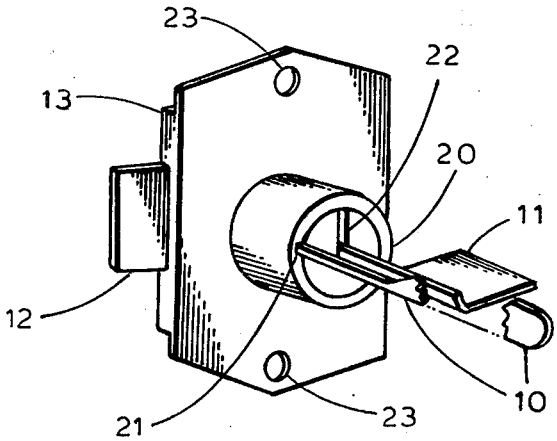
FIG. 3 is a perspective front view of a lever tumbler lock with the pick and tension wrench in position for picking.

Refer to FIG. 3. The pick 10 and the tension wrench 11 are shown in the same position as in FIG. 1 with the coverplate 20 and key guide 22 in place. The pick 10 remains in the key escape notch in the area of the throat

21 and the wrench 11 is rotated clockwise causing its protrudance 27 (FIG. 5) to force the bolt 12 to slide into the case 13 unlocking the lock.

It should be noted that the present invention will only operate on lever tumbler locks in which the tumblers 16 are all of the same outside profile and thus have a common surface 31. In addition, the lock key guide 22 must leave clearance for the pick 10 at the throat area 21 as the tension wrench 11 is rotated. This generally limits the present invention to the lower priced locks but does not distract from its value. There are millions of relatively inexpensive letter box, desk drawer locks in existence, many of which will require picking. The present invention will be added to the locksmith's assortment of specialized picks which save considerable time in picking locks.

Figure 4:
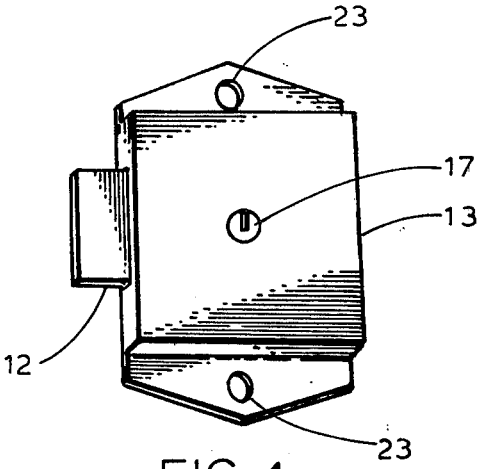
FIG. 4 is a perspective rear view of a typical lever tumbler lock.
Figure 6:
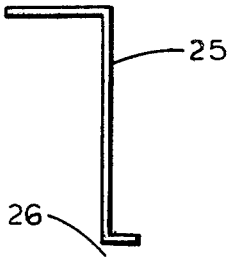
FIG. 6 PRIOR ART
FIG. 6 is a typical spring wire tension wrench generally used for picking lever tumbler locks.

FIG. 6 depicts a common tension wrench 25 for use in picking lever tumbler locks. The present invention, tension wrench 11, is improved by adding tip 28. The tension wrench 25 now in use is without a tip 26 and is difficult to control, making picking a more time consuming task.

It should be understood that some modifications may be made to the pick set as above, without deviating from the broader aspects thereof.

Now therefore I claim:

1. A lock pick set for picking lever tumbler locks comprising:

a. a pick with a handle and a shank sized to work in the throat area of a lever tumbler lock key guide;

b. said pick having a flat surface on the end, opposite said handle, said surface being generally parallel to the pick shank and of a length equal to the combined thickness of the lever tumblers of a lock to be picked;

c. a tension wrench with a handle and a shank to work in the lock key guide, in conjunction with said pick, with a tip opposite the handle end and a protrusion, adjacent to the tip, sized and situated to contact a bolt of said lock;

d. said pick being adapted to lift the lever tumblers on their common surface to allow a bolt stop to enter lever tumbler gates as the rotating tension wrench protrusion, stabilized by the tip, forces the bolt to an unlocked position.

* * * * *